US009413125B2

(12) United States Patent
Fontaine et al.

(10) Patent No.: US 9,413,125 B2
(45) Date of Patent: Aug. 9, 2016

(54) COUPLER CONNECTOR AND CABLE TERMINATOR WITH END CONTACTS

(71) Applicant: BELDEN CANADA INC., Saint-Laurent (CA)

(72) Inventors: Marc Fontaine, Les Cedres (CA); Jean-Sebastien Plamondon, Laval (CA); Virak Siev, Montreal (CA); Alain Desroches, Les Cedres (CA); Luc Milette, Montreal (CA); Francois Beauregard, La Prairie (CA)

(73) Assignee: BELDEN CANADA INC., Saint-Laurent (CA)

( * ) Notice: Subject to any disclaimer, the term of this patent is extended or adjusted under 35 U.S.C. 154(b) by 0 days.

(21) Appl. No.: 14/845,607

(22) Filed: Sep. 4, 2015

(65) Prior Publication Data

US 2016/0072241 A1 Mar. 10, 2016

Related U.S. Application Data

(60) Provisional application No. 62/045,656, filed on Sep. 4, 2014.

(51) Int. Cl.

| | |
|---|---|
| ***H01R 4/24*** | (2006.01) |
| ***H01R 24/64*** | (2011.01) |
| ***H01R 43/16*** | (2006.01) |
| *H01R 107/00* | (2006.01) |

(52) U.S. Cl.

CPC ..... *H01R 24/64* (2013.01); *H01R 43/16* (2013.01); *H01R 2107/00* (2013.01)

(58) Field of Classification Search

CPC ..... H01R 4/2416; H01R 4/245; H01R 4/2462

USPC ..... 439/676, 418, 404

See application file for complete search history.

(56) References Cited

U.S. PATENT DOCUMENTS

| | | | | |
|---|---|---|---|---|
| 6,371,793 | B1 | 4/2002 | Doorhy et al. | |
| 7,252,554 | B2 | 8/2007 | Caveney et al. | |
| 7,670,193 | B2 * | 3/2010 | Milette | H01R 24/64 439/676 |
| 7,823,281 | B2 * | 11/2010 | Caveney | H05K 1/0228 29/827 |
| 2009/0149082 | A1 * | 6/2009 | Leubner | H01R 9/2475 439/676 |
| 2016/0072240 | A1 * | 3/2016 | Fontaine | H01R 4/2404 439/397 |

FOREIGN PATENT DOCUMENTS

| | | | |
|---|---|---|---|
| CA | 2468007 | A1 | 11/2004 |
| CA | 2694884 | A1 | 2/2009 |

OTHER PUBLICATIONS

International Search Report of corresponding PCT application No. PCT/CA2015/050848, Sep. 4, 2015.

* cited by examiner

*Primary Examiner* — Phuong Dinh

(74) *Attorney, Agent, or Firm* — Goudreau Gage Dubuc; Hugh Mansfield

(57) ABSTRACT

An assembly comprising a cable terminator comprising an elongate wire guide comprising a top end and four conductor pair receiving channels, and a securing cap configured for installation over the top end and comprising four pairs of piercing contacts exposed on an upper surface is disclosed. Each pair of the piercing contacts are interconnected with a respective conductor pair, and a coupler connector comprising a forward surface comprising an RJ-45 compatible socket, wherein tines are exposed within the socket and a rearward surface comprising a cable terminator receiving socket. Pairs of contacts are exposed on an end wall of the socket. Each of the tines is interconnected with a respective one of the contacts. When the cable terminator is inserted into the cable terminator receiving socket, the upper surface of the securing cap is positioned against the end wall and each of the piercing contacts comes into contact with a respective one of the contacts, thereby interconnecting each of the tines with one of the conductors.

14 Claims, 8 Drawing Sheets

COUPLER CONNECTOR AND CABLE TERMINATOR WITH END CONTACTS

CROSS REFERENCE TO RELATED APPLICATIONS

This application claims benefit, under 35 U.S.C. § 119(e) of U.S. provisional application Ser. No. 62/045,656, filed on Sep. 4, 2014 which is incorporated herein in its entirety by reference.

FIELD OF THE INVENTION

The present invention relates to a coupler connector and cable terminator with end contacts. In particular, the present application relates to two part coupler connector for simplified field installation.

BACKGROUND TO THE INVENTION

The prior art discloses a variety of assemblies for terminating communications cables in the field. One drawback of such prior art assemblies is that they typically require the individual conductors of the communications cable to be threaded or fished through a small opening prior to being pierced by an insulation displacement connector or the like to provide conductive contact. As a result, such prior art assemblies require skill and/or time to assemble and therefore are inefficient and cumbersome. Additionally, the mechanical strength of such prior art assemblies is limited thereby allowing the assembly to be inadvertently disassembled, for example through forceful tugging on the cable or the like.

SUMMARY OF THE INVENTION

In order to address the above and other drawbacks, there is provided an assembly for terminating a cable comprising four pairs of conductors. The assembly comprises a cable terminator comprising an elongate wire guide comprising a top end and four conductor pair receiving channels, and a securing cap configured for installation over the top end and comprising four pairs of piercing contacts exposed on an upper surface thereof, wherein each pair of the piercing contacts are interconnected with a respective conductor pair, and a coupler connector comprising a forward surface comprising an RJ-45 compatible socket disposed therein, wherein eight tines are exposed within the RJ-45 compatible socket and a rearward surface comprising a cable terminator receiving socket disposed therein, wherein four pairs of contacts are exposed on an end wall of the socket, and further wherein each of the tines is interconnected with a respective one of the contacts. When the cable terminator is inserted into the cable terminator receiving socket, the upper surface of the securing cap is positioned against the end wall and each of the piercing contacts comes into contact with a respective one of the contacts, thereby interconnecting each of the tines with a respective one of the conductors.

There is also disclosed a method for terminating a cable comprising a jacket surrounding four pairs of conductors. The method comprises removing a length of the jacket from an end of the cable to expose a free end of each of the pairs of conductors, feeding the free ends in a respective conductor pair receiving slot in a wire guide, placing a cap over a top end of the wire guide, the cap comprising a plurality of pairs of piercing contacts arranged along an upper surface thereof, wherein when the cap is installed on the top end, each of the pairs of piercing contacts align with a respective pair of conductors, piercing an insulation of each of the conductors with a piercing first end of an aligned one of the piercing contacts, wherein a contacting second end of each of the piercing contacts remains exposed on the upper surface, inserting the cap and the wire guide into a cap and wire guide receiving socket in a rearward surface of a coupler connector such that each of the contacting second ends of the piercing contacts comes into contact with a respective one of eight contacts exposed on an end wall of the cap and wire guide receiving socket, the coupler connector further comprising a forward surface comprising an RJ-45 compatible socket disposed therein, wherein eight tines are exposed within the RJ-45 compatible socket and each of the tines is interconnected with a respective one of the contacts.

DETAILED DESCRIPTION OF THE ILLUSTRATIVE EMBODIMENTS

Figure 1:
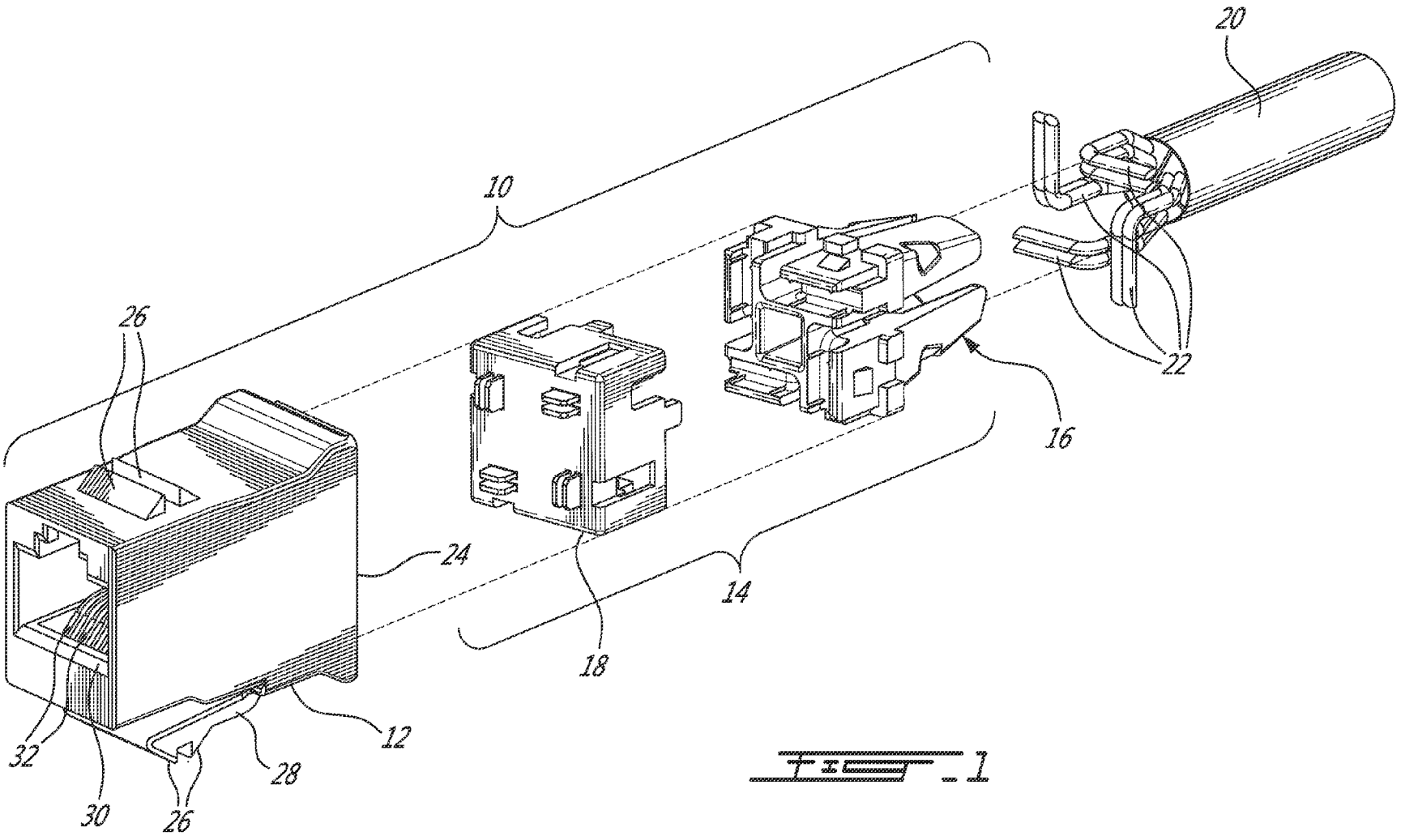
FIG. 1 is exploded view of a coupler connector and cable terminator with end contacts in accordance with an illustrative embodiment of the present invention.

Referring now to FIG. 1, a coupler connector and cable terminator with end contacts, generally referred to using the reference numeral 10, will now be described. The coupler connector 12 mates with the cable terminator 14 which comprises a wire guide 16 and securing cap 18 for terminating a communications cable 20 comprised of four pairs, typically twisted, of conductors as in 22.

Still referring to FIG. 1, illustratively, the housing 24 of the coupler connector 12 is dimensioned for insertion into a keystone type socket (not shown) and within which a series of socket engaging tabs as in 26 are formed. As the keystone type sockets are typically formed in a rigid cover plate or patch panel manufactured from sheet steel, for example, typically at least one of the tabs as in 26 is attached to the housing 24 via a flexible mounting 28. A socket 30 is formed in the front of the coupler connector 12 for receiving and securing a plug (not shown), illustratively in conformance with RJ-45. A plurality of tines as in 32 are positioned within the socket 30 for engaging with respective terminal contacts of the plug (also not shown).

Figure 2B:
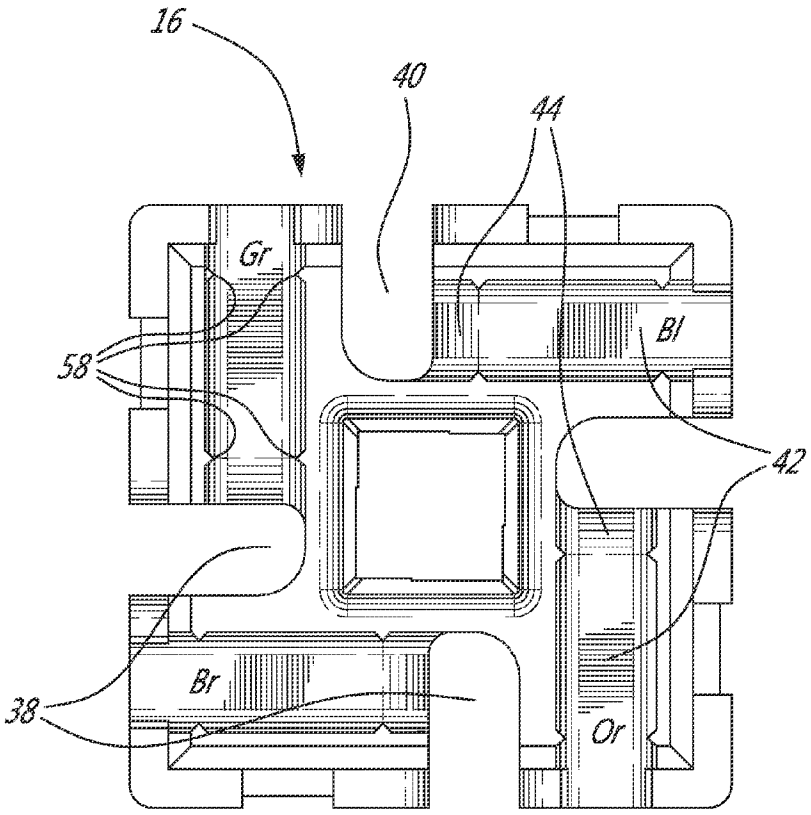
FIGS. 2A, 2B and 2C provided respectively isometric, top plan and bottom plan views of a wire guide in accordance with an illustrative embodiment of the present invention.
Figure 2A:
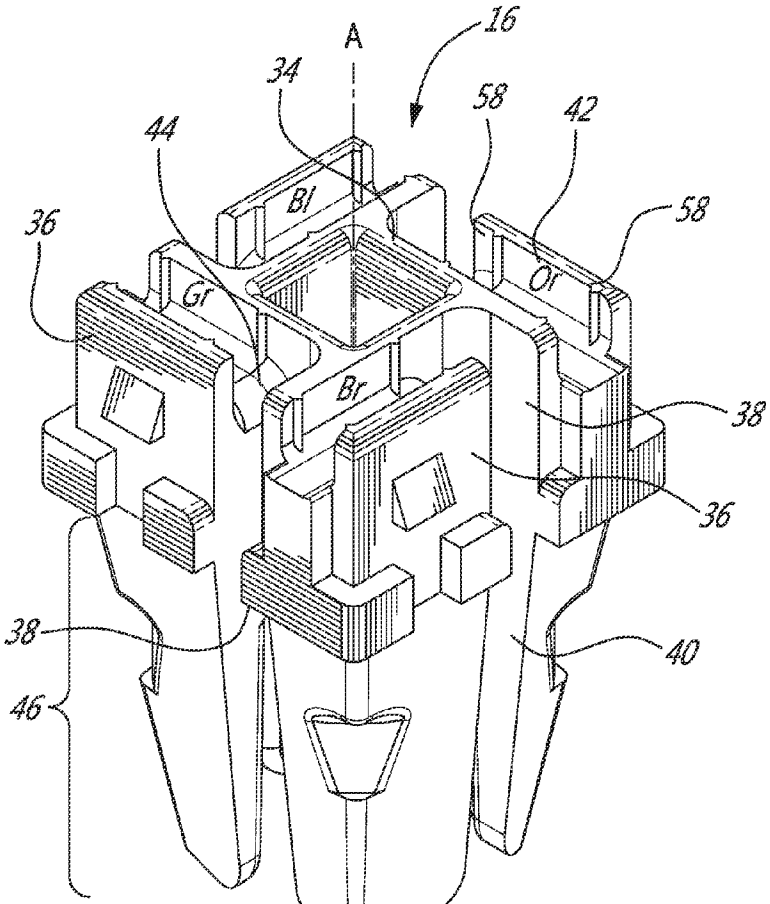

Referring now to FIGS. 2A and 2B, the wire guide 16 is formed from a rigid material such as plastic or metal and comprises and top end 34, a plurality of side edges 36, four (4) channels as in 38 each for receiving a respective pair of conductors as in 22. As known in the art, the insulated pairs of conductors as in 22 are typically colour coded, and the channels as in 38 can also be provided with a colour coding such as (Gr)een, (Bl)ue, (Or)ange, (Br)own or the like to simplify installation and ensure that the installer does not inadvertently misplace a conductor pair as in 22. Each channel as in 38 is illustratively accessible from the side such that a pair of conductors as in 22 can be fed into the channel 38 without the requirement of fishing or feeding the conductor(s) through an aperture or hole or the like. Each channel as in 38 comprise a first portion 40 which runs in parallel to an axis A of the wire guide 16 and a second portion 42 substantially at right angles to the first portion 40. A smooth curved portion 44 is provided between the first portion 40 and the second portion 42 to ensure that the pairs of conductors as in 22 smoothly transition from the first part 40 to the second part 42.

Figure 2C:
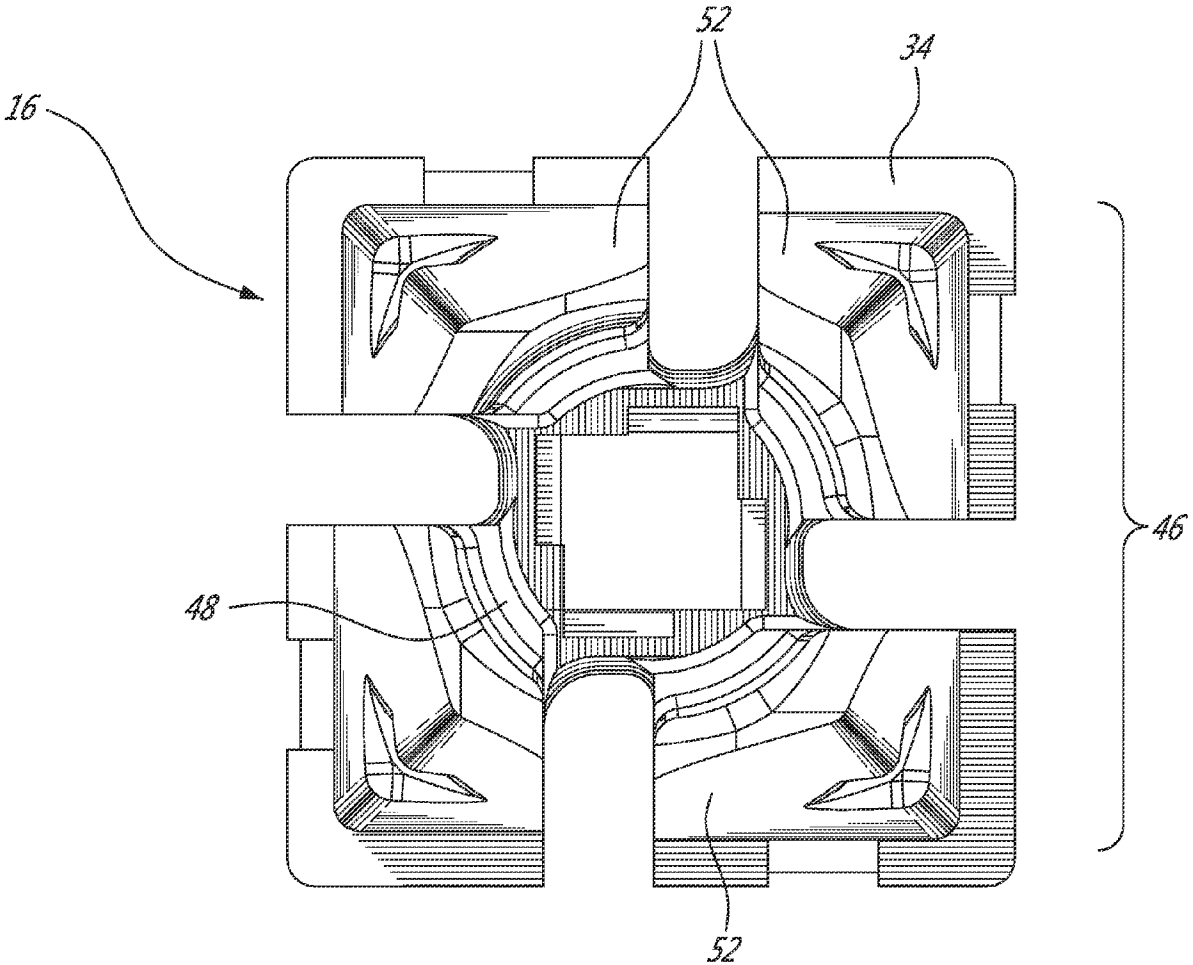

Referring now to FIG. 2C in addition to FIG. 2A, the wire guide 16 further comprises a cable receiving cuff 46 opposite said top end 34. The cuff 46 defines a circular cable receiving opening 48 at a bottom end 50 thereof.

Figure 3C:
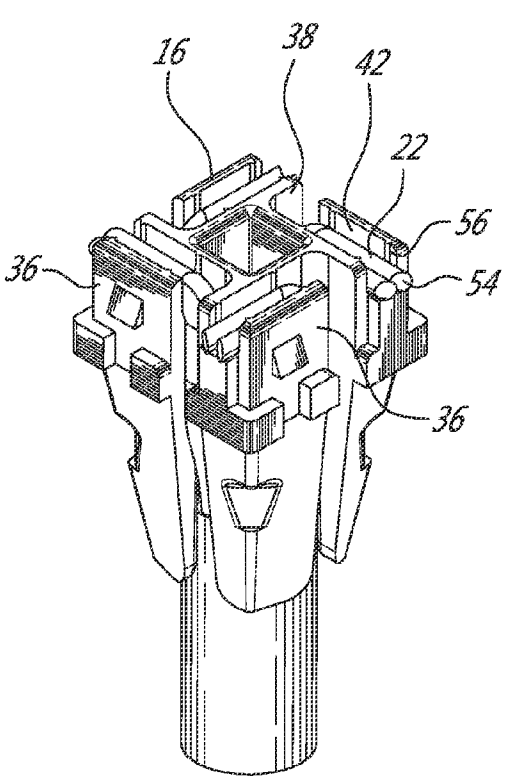
FIGS. 3A through 3C provide a series of isometric view detailing the installation of a cable into a wire guide and in accordance with an illustrative embodiment of the present invention.
Figure 3B:
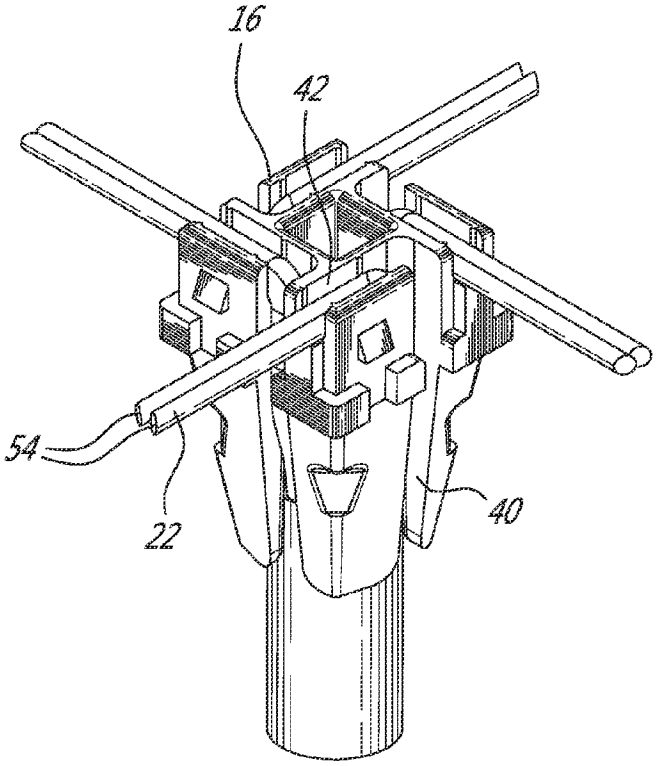
Figure 3A:
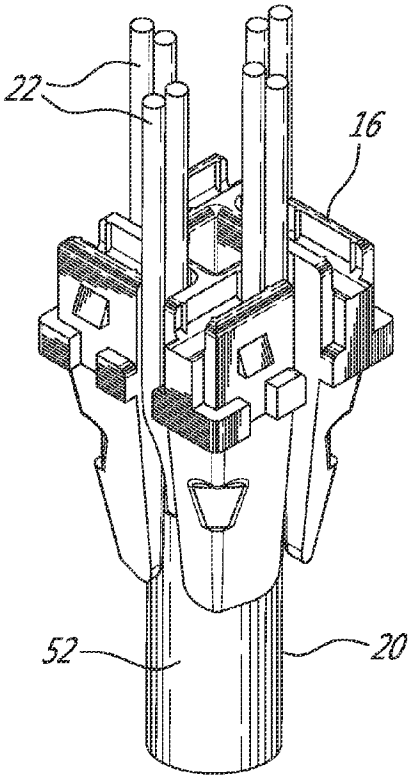

Referring now to FIG. 3A, in order to install the conductors 22 of a cable 20 into the wire guide 16 the jacket 52 is removed from the end of the cable 20 to expose a length of the pairs of conductors 22. The pairs of conductors 22 are separated from one another and inserted lengthwise into a respective first portion 40 of the channels 38. Referring to FIG. 3B, if the pairs of conductors as in 22 are twisted pairs, the ends 54 of the conductors 22 are first untwisted such that they run straight and in parallel. The ends 54 of the conductors 22 are then easily gripped by the installer and bent over the curved shoulder (reference 44 in FIG. 2A) such that the straight and in parallel portion of the conductors lies within the second part 42 of the channel 38. Referring to FIG. 3C, the ends 54 of the conductors 22 are then trimmed such that they lie flush with the end 56 of the second portion 42 of the channel 38, and flush with a respective side edge 36 of the wire guide 16. Provision of the bend in the pairs of conductors as in 22 about the shoulder as in 44 increases the strain relief of the assembly, thereby decreasing, for example, that a cable is inadvertently removed from the wire guide as in 16 for example by tugging on the cable 20 when installed.

Referring back to FIGS. 2A and 2B, in order to retain the conductors 22 in their respective second parts as in 42 of the channels as in 38, pairs of opposing bosses as in 58 are providing within the second portions 42 of the channels 38. The bosses 58 engage the insulated outer covering of the conductors 22 in a friction fit. Additionally, a ridge (not shown) can be provided along the bottom of and dividing the second portion 42 lengthwise such that the pair of conductors 22 are better retained within the second portion 42 in parallel and side by side.

Figure 4A:
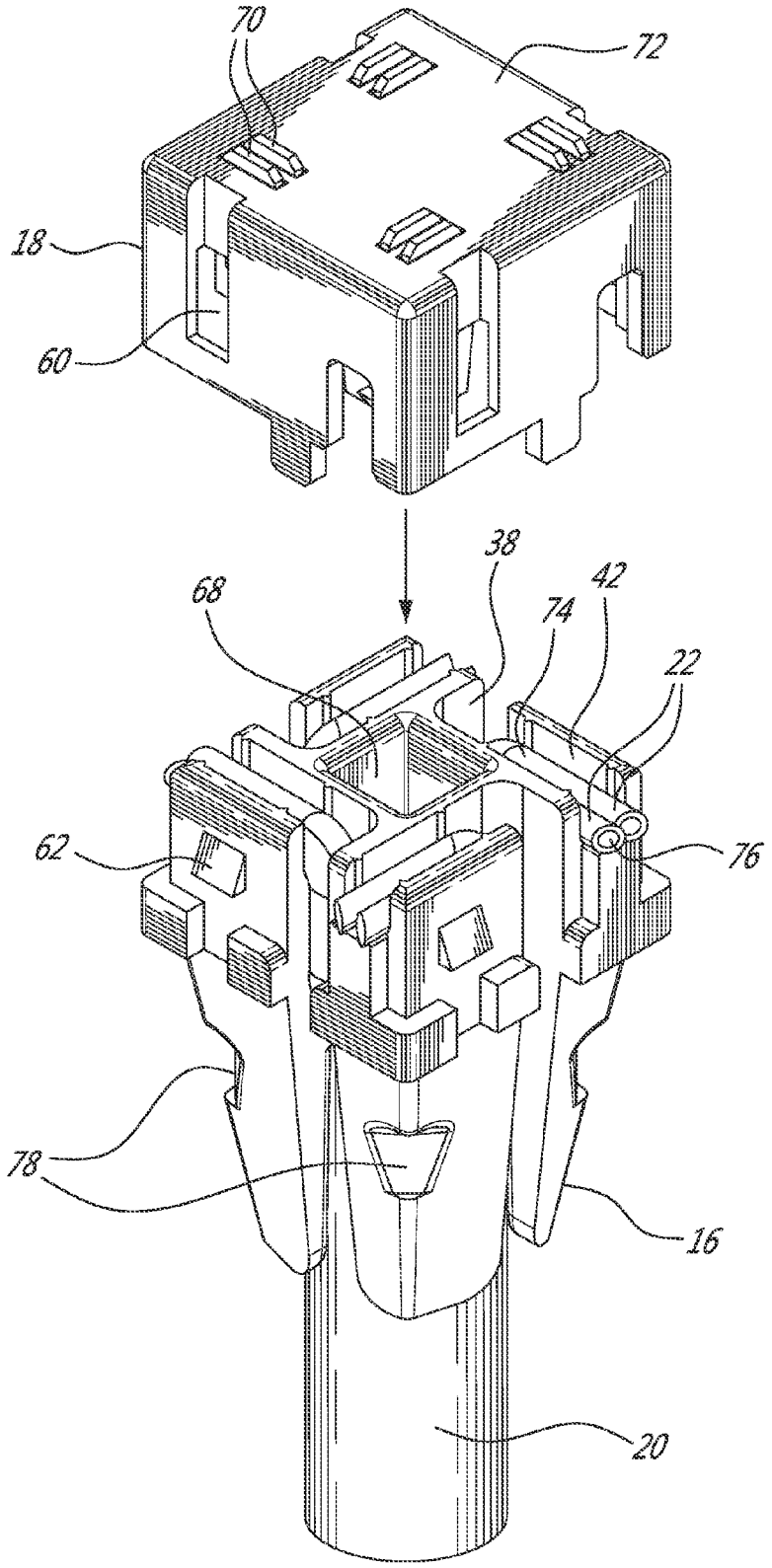
FIGS. 4A and 4B provide isometric views detailing the installation of a securing cap onto a wire guide and in accordance with an illustrative embodiment of the present invention.
Figure 4C:
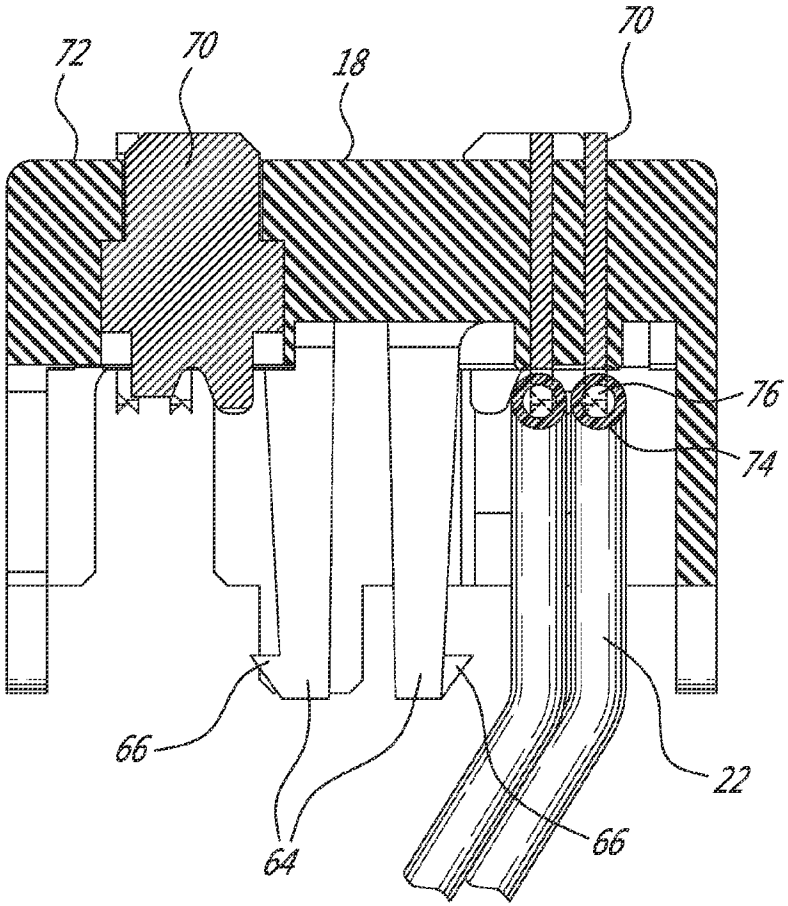
FIG. 4C provides a sectional view of a securing cap along line IVC-IVC in FIG. 4B.
Figure 4B:
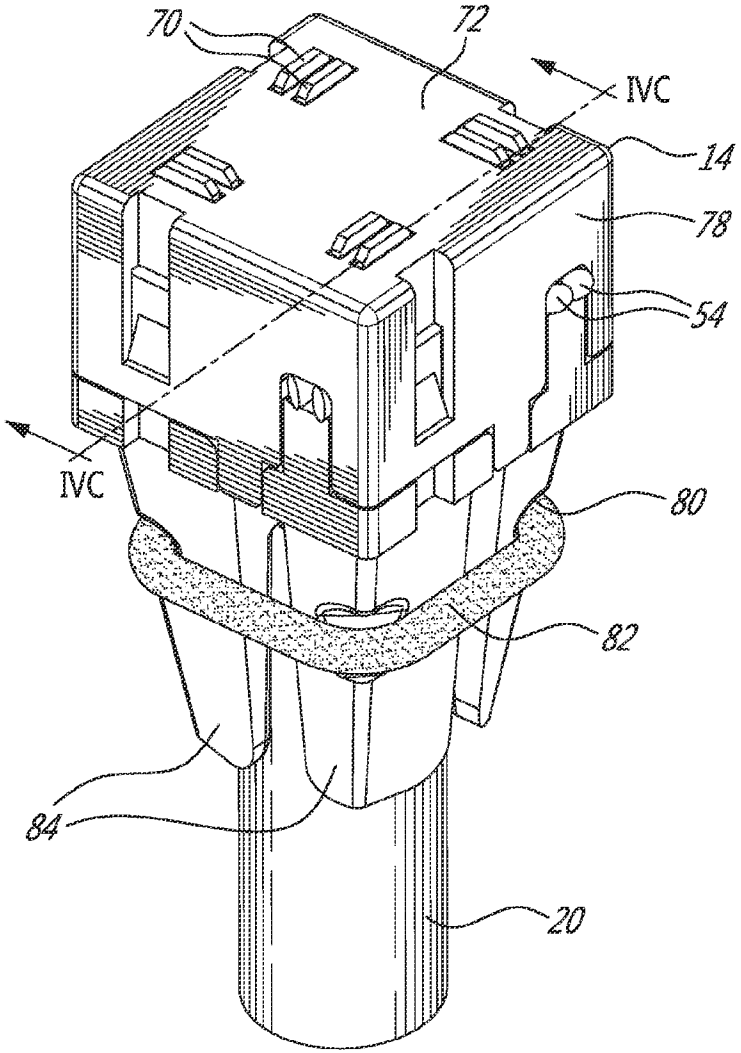

Referring now to FIG. 4A, once the pairs of conductors as in 22 are within their respective channels 38 of the wire guide 16, the securing cap 18 is placed over the end of the wire guide 16 to form the cable terminator 14 (FIG. 4B). The securing cap 18 comprises a plurality of slots as in 60 in a cap side thereof which engage with complementary raised tabs as in 62 on a side of the wire guide 16 in order to retain the securing cap 18 snuggly on the wire guide 16.

Referring to FIG. 4C in addition to FIG. 4A, in a particular embodiment a pair of opposed flexible arms as in 64 each comprising a raised tab 66 toward an end thereof may be provided which engage with a complementary aperture 68 formed in the center of the wire guide 16, thereby improving the stability of the interconnection between securing cap 18 and wire guide.

Referring back to FIG. 4A, pairs of piercing contacts as in 70, manufactured from a highly conductive material and illustratively plated in gold, are provided along an upper surface 72 of the securing cap 16. Upon assembly of the securing cap 18 to the wire guide 16, the piercing contacts engage a region along the length of the pairs of conductors as in 22 held within the second portion 42 of the channels 38, thereby displacing the outer insulation layer 74 (FIG. 4C) of a respective one of the conductors and coming into contact with the conductive core 76. Once installed, the piercing contacts as in 70 remain exposed along the upper surface 72 of the securing cap 16.

Referring to FIGS. 4B and 4C in addition to FIG. 4A, in order to secure the securing cap 18 to the wire guide 16, a tool (not shown) is typically used which, during installation of the cap 18 on the wire guide 16 cuts the ends 54 of the pairs conductors as in 22 flush with an outer surface 78 of the securing cap 18 while simultaneously driving the pairs of piercing contacts as 70 into their respective conductors as in 22. In order to improve the mechanical strength of the interconnection between the cable 20 and the cable terminator 14 a series of band receiving notches as in 80 are provided about which a crimping ring or securing band 82 or the like. The band 82 causes the individual fingers as in 84 of the wire guide 16 to be deflected inwards such that their inner surface grips a jacket (outer surface) of the cable 20. Alternatively, the outer surface of the fingers as in 84 could be manufactured to include a thread (no shown) such that a flexible boot or the like (also not shown), and comprising an aperture through which the cable 20 can be inserted, can be threaded onto the fingers as in 84 again causing the legs to be lightly deflected inwards such that they exert a gripping force on the cable 20.

Figure 5:
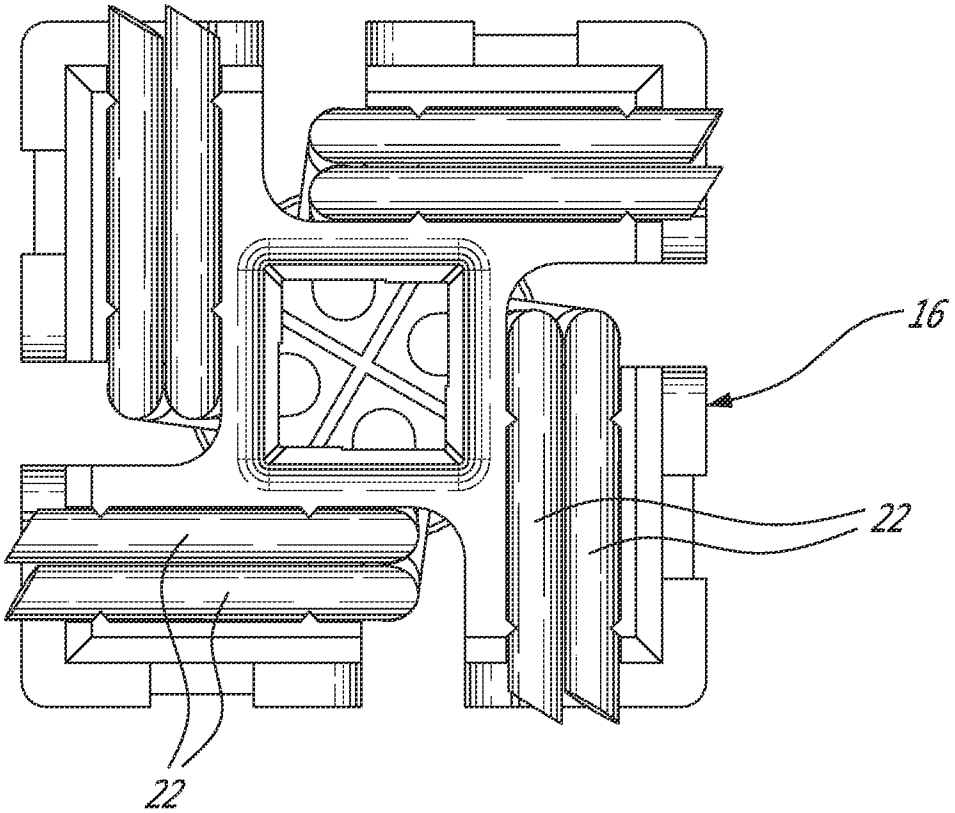
FIG. 5 provides a top plan view of a wire guide with pairs of conductors installed and in accordance with an illustrative embodiment of the present invention.

Referring now to FIG. 5, of note is that the wire guide retains the pairs of conductors as in 22 such that adjacent pairs are arranged at right angles to one another, which reduces cross-talk generated between the ends of the pairs of conductors as in 22. Referring back to FIG. 4B, a similar arrangement is arrived at with the pairs of piercing contacts as in 70 wherein the flat surfaces of a given pair of piercing contacts are arranged substantially at right angles to those of an adjacent pair of piercing contacts.

Figures 6A, 6B:
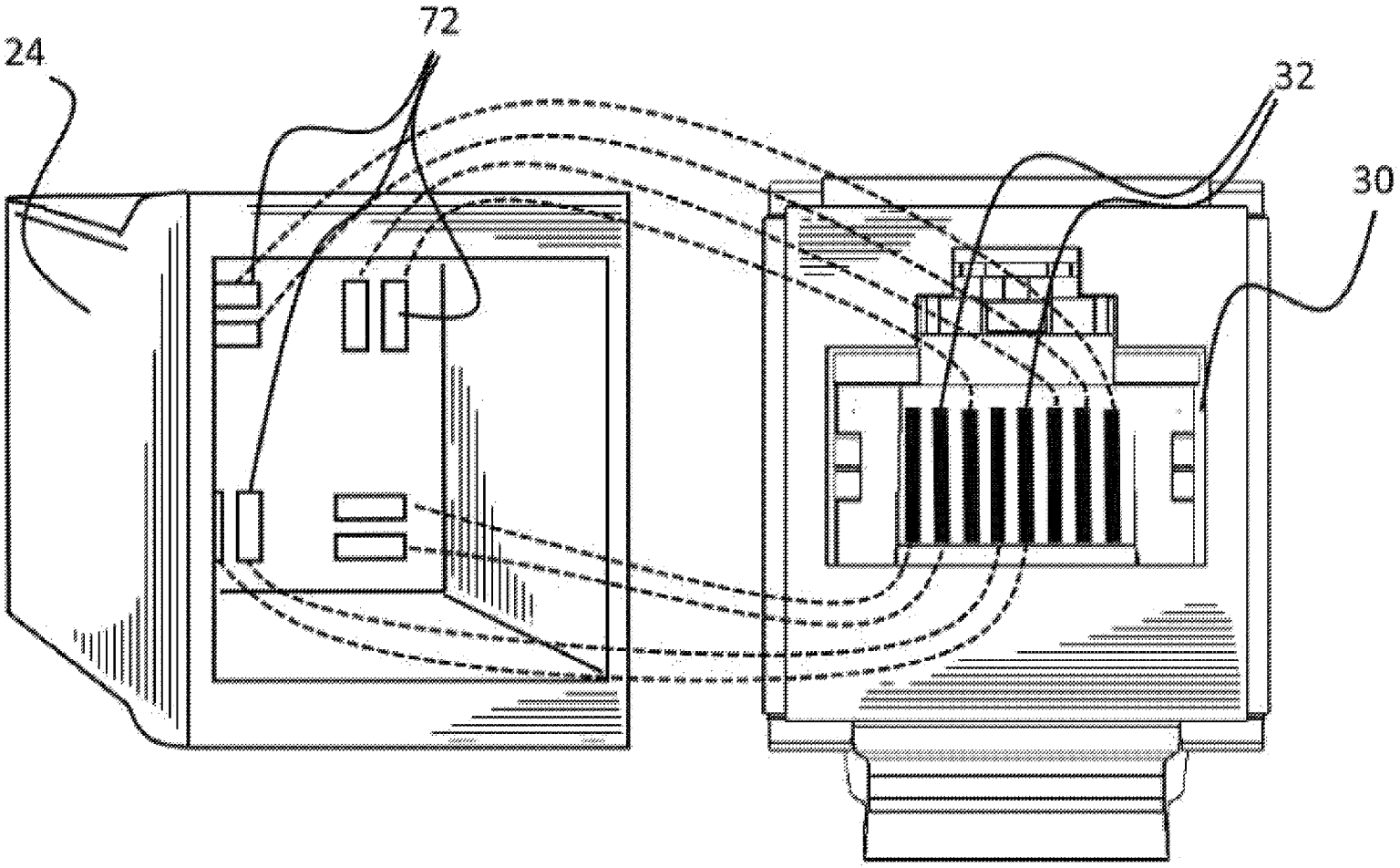
FIGS. 6A and 6B provide respectively a rear (back) and front view of a socket in accordance with an illustrative embodiment of the present invention.

Referring now to FIGS. 6A and 6B in addition to FIG. 1, following assembly of the cable 20 with the wire guide 16 and the securing cap 18 (see FIG. 4B), the cable terminator 14 is inserted into the back of the coupler connector 12 where the piercing contacts as in 70 come into contact with respective complementary contacts 72 exposed along an inner surface of the coupler connector 12, and one of each of which is interconnected with a respective one of the tines 32 (the interconnection between a contact 72 and a respective tine 32 indicated by the dashed lines). In this manner individual conductors as in 22 are interconnected with respective ones of the tines 32.

Although the present invention has been described hereinabove by way of specific embodiments thereof, it can be modified, without departing from the spirit and nature of the subject invention as defined in the appended claims.

We claim:

1. An assembly for terminating a cable comprising four pairs of conductors, the assembly comprising:

a cable terminator comprising:

an elongate wire guide comprising a top end and four conductor pair receiving channels; and a securing cap configured for installation over said top end and comprising four pairs of piercing contacts exposed on an upper surface thereof, wherein each pair of said piercing contacts are interconnected with a respective conductor pair; and a coupler connector comprising a forward surface comprising an RJ-45 compatible socket disposed therein, wherein eight tines are exposed within said RJ-45 compatible socket and a rearward surface comprising a cable terminator receiving socket disposed therein, wherein four pairs of contacts are exposed on an end wall of said socket, and further wherein each of said tines is interconnected with a respective one of said contacts;

wherein when said cable terminator is inserted into said cable terminator receiving socket, said upper surface of said securing cap is positioned against said end wall and each of said piercing contacts comes into contact with a respective one of said contacts, thereby interconnecting each of said tines with a respective one of the conductors.

2. The assembly of claim 1, wherein each of said conductor pair receiving channels comprises a first portion running a long a length of said wire guide, a second portion in said flat end and at right angles to said first portion and a curved portion interconnecting each of said first portions with a respective one of said second portions.

3. The assembly of claim 2, wherein each second portion is arranged along a respective axis and further wherein each of said axes intersects another of said axes at right angles.

4. The assembly of claim 1, wherein said wire guide further comprises a plurality of tabs protruding from a wire guide side and said cap comprises plurality of slots in a cap side and further wherein said tabs engage respective ones of said slots when said cap is placed over said wire guide, thereby retaining said cap against said wire guide.

5. The assembly of claim 1, wherein said wire guide further comprises a cable receiving cuff opposite said flat end and defining a cable receiving opening opposite said flat end.

6. The assembly of claim 5, wherein said cable receiving opening is substantially circular.

7. The assembly of claim 5, wherein said cuff is comprised of four elongate flexible fingers, each of said fingers separated from an adjacent flexible finger by one of said four conductor pair receiving slots and comprising a transverse crimp receiving notch on an outer surface thereof.

8. The assembly of claim 7, wherein the cable comprises a jacket and each of said elongate flexible fingers combine to define a cylindrical inner surface adapted for gripping the jacket.

9. The assembly of claim 7, wherein each of said fingers is separated from an adjacent one of said fingers by one of said four conductor pair receiving slots.

10. The assembly of claim 8, further comprising a band and wherein each of said fingers comprises a transverse band receiving notch on an outer surface thereof, wherein securing said band in said band receiving notches forces said flexible fingers inwards such that said cylindrical inner surface grips the cable jacket.

11. A method for terminating a cable comprising a jacket surrounding four pairs of conductors, the method comprising:

removing a length of said jacket from an end of said cable to expose a free end of each of said pairs of conductors;

feeding said free ends in a respective conductor pair receiving slot in a wire guide;

placing a cap over a top end of said wire guide, said cap comprising a plurality of pairs of piercing contacts arranged along an upper surface thereof, wherein when said cap is installed on said top end, each of said pairs of piercing contacts align with a respective pair of conductors;

piercing an insulation of each of said conductors with a piercing first end of an aligned one of said piercing contacts, wherein a contacting second end of each of said piercing contacts remains exposed on said upper surface;

inserting said cap and said wire guide into a cap and wire guide receiving socket in a rearward surface of a coupler connector such that each of said contacting second ends of said piercing contacts comes into contact with a respective one of eight contacts exposed on an end wall of said cap and wire guide receiving socket, said coupler connector further comprising a forward surface comprising an RJ-45 compatible socket disposed therein, wherein eight tines are exposed within said RJ-45 compatible socket and each of said tines is interconnected with a respective one of said contacts.

12. The method of claim 11, further comprising using a tool configured to receive said cable, cap and wire guide to move said piercing contacts relative to said cap such that they pierce an insulation of said conductors.

13. The method of claim 11, wherein each of said conductor pair receiving slots comprises a first slot portion running substantially in parallel to a length of said wire guide, a second slot portion at right angles to said first slot portion and exposed at said top end and a curved portion interconnecting said first and second slot portions, and further wherein said feeding comprises feeding each of said free ends into a respective one of said first slot portions, over a respective one of said curved portions and into a respective one of said second slot portions.

14. The method of claim 13, wherein each of said second slot portions ends at a side edge of said wire guide, and wherein prior to said cap being placed over a top end of said wire guide, said free ends are trimmed such that they are flush with said side edge.

* * * * *